US008444020B1

(12) United States Patent
Kenny

(10) Patent No.: US 8,444,020 B1
(45) Date of Patent: May 21, 2013

(54) ASSEMBLY FOR HAND HELD OR REMOTE ELEVATED OPERATION OF AEROSOL SPRAY CANS

(76) Inventor: Mark Kenny, Worth, IL (US)

( * ) Notice: Subject to any disclaimer, the term of this patent is extended or adjusted under 35 U.S.C. 154(b) by 484 days.

(21) Appl. No.: 12/752,264

(22) Filed: Apr. 1, 2010

(51) Int. Cl.
*B67D 7/84* (2010.01)

(52) U.S. Cl.
USPC ..... 222/174; 222/162; 222/402.15; 222/473

(58) Field of Classification Search
USPC ..... 222/173–174, 162, 324, 402.1, 182, 222/402.15, 472–473, 323
See application file for complete search history.

(56) References Cited

U.S. PATENT DOCUMENTS

| | | | | | |
|---|---|---|---|---|---|
| 1,947,088 | A | * | 2/1934 | Johnson et al. | 222/318 |
| 2,830,742 | A | * | 4/1958 | Gibbons et al. | 222/323 |
| 3,017,056 | A | | 1/1962 | Bishop | |
| 3,229,859 | A | | 1/1966 | Conroy et al. | |
| 3,485,206 | A | * | 12/1969 | Smrt | 118/305 |
| 3,716,195 | A | | 2/1973 | Silva | |
| 3,856,209 | A | | 12/1974 | Hickson | |
| 4,089,440 | A | | 5/1978 | Lee | |
| 4,124,148 | A | * | 11/1978 | Vieler et al. | 222/321.8 |
| 4,401,240 | A | * | 8/1983 | Brack | 222/323 |
| 4,579,258 | A | | 4/1986 | Brown et al. | |
| 4,886,191 | A | * | 12/1989 | Yoshitomi | 222/174 |
| 5,307,959 | A | | 5/1994 | Bedore et al. | |
| 5,518,148 | A | * | 5/1996 | Smrt | 222/174 |
| 6,364,177 | B1 | * | 4/2002 | Taylor | 222/473 |
| 6,966,461 | B2 | | 11/2005 | Warner et al. | |
| 7,040,510 | B1 | * | 5/2006 | Hester | 222/174 |
| 7,252,210 | B1 | * | 8/2007 | Schultz et al. | 222/174 |
| 7,314,149 | B1 | * | 1/2008 | White | 222/174 |
| 7,674,060 | B2 | * | 3/2010 | Lucero | 401/123 |
| 7,717,300 | B1 | * | 5/2010 | Yarrusso, Jr. | 222/174 |

* cited by examiner

*Primary Examiner* — Frederick C. Nicolas
(74) *Attorney, Agent, or Firm* — Marian J. Furst

(57) ABSTRACT

Assembly for hand held or remote elevated operation of most modern style aerosol cans. The assembly comprises a frame having a handle, a saddle, a swiveling threaded adaptor, and an activating linkage. An aerosol can is held to the device with a clamp. For use in a manual fashion, the user may grasp the handle and depress a lever link of the activating linkage, such with a thumb or palm of a hand. For use in an elevated position, the assembly can be threaded onto a painters' extension pole using an indexing adaptor. The can may then be elevated, and the user can activate the assembly simply by pulling down on a tether.

18 Claims, 8 Drawing Sheets

ASSEMBLY FOR HAND HELD OR REMOTE ELEVATED OPERATION OF AEROSOL SPRAY CANS

INCORPORATION BY REFERENCE

This application incorporates by reference in its entirety U.S. patent application Ser. No. 12/578,559, confirmation no. 6763, submitted to the U.S. Patent and Trademark Office on Oct. 13, 2009, entitled "Multiple Function Hand Held or Remote Operating Assembly while Elevating Aerosol Spray Cans," invented by Mark Kenny.

FIELD OF THE INVENTION

The present invention relates to an apparatus for operating aerosol spray cans, and more particularly to an apparatus for either hand-held or remote elevated operation of aerosol spray cans.

BACKGROUND

It is frequently desirable to elevate aerosol spray cans beyond one's reach and activate the spray remotely. Several devices are known that allow such a procedure. Most of these devices are designed for operation either using a handle located near the can or operation using a pole to position the can farther away from the user, but not both. In general, the can is held in a fixed orientation relative to device. U.S. Pat. No. 3,017,056 describes a device in which a can holder is relative to a tubular support pole, with the valve opened to release the can contents whenever the can is tilted relative to the pole. Devices are also known for operating a hand-held can, using one's hand to grip the handle and pull a lever that allows the contents of the can to be released.

Most or all known devices can only be used on cans with standard push-button apertures, and they will not work with the newer safety style buttons having an angled contact surface. If prior art devices intended for use with the older buttons are used on angled safety buttons, they will hang up or lock the valve down in the open position, such that when the user releases the activating mechanism, the valve will remain in an open position and will not return to a closed position to cut off the flow of the cans contents. This can waste the contents of the can, distribute the contents undesirably, and, possibly, create a dangerous situation.

SUMMARY

To achieve the foregoing and other objects and in accordance with the purpose of the present invention broadly described herein, one embodiment of this invention comprises an apparatus for operating an aerosol can. The can has a button-operated valve on its top for releasing the contents of the can. The apparatus comprises a frame with a saddle for positioning and holding the can, a handle, and a mount for a linkage mechanism. It also comprises a linkage mechanism for controlling the valve on the can. The mechanism is retained pivotally by the frame and comprises a plurality of pivotally connected links. The mechanism terminates proximally with a rotatable wheel. The apparatus further comprises means for securing an aerosol can to the frame with the valve on the can positioned for operation by the linkage mechanism.

The apparatus may further comprise indexing means on the frame for connecting an extension pole. The pole has a lengthwise axis, and the indexing means locks the pole with the lengthwise axis at a predetermined angle relative to a long axis of the frame. The apparatus may further comprise a tether joined to the distal end of the linkage mechanism, with the tether passing through a portion of the frame. The tether is preferably sufficiently long to allow operation of the valve when the can is elevated using an extension pole coupled to the indexing means. The indexing means may comprise an upper portion joined to the frame and having a first lengthwise axis, and a lower portion distal from the frame having a first toothed bearing surface. In this case, the indexing means also comprises a lower portion having a second lengthwise axis and a second toothed bearing surface proximal to the frame and a distal portion adapted for joining an extension pole. The upper and lower portions are pivotally joined with a hinge through the first and second bearing surfaces, such that the bearing surfaces mate with each other for locking the frame portions with the first and second lengthwise axes positioned at a selected angle relative to each other. The lower portion of the indexing means may include an internally threaded hole for joining an extension pole. Also, the apparatus may further comprise at least one spring for biasing the linkage mechanism in a position where the valve on the can is closed. The linkage mechanism may comprise a lever link having a distal end and a proximal end; a connecting link having a distal end hingedly attached to the proximal end of the lever link; and a contact link having a distal end hingedly attached to the connecting link, with the wheel positioned at the proximal end of the contact link. The means for securing may comprise a loop structure attached to the saddle, such as a hose clamp with a hand-adjustable screw.

Another embodiment of the present invention comprises an apparatus for operating an aerosol can. The can has a button-operated valve on top of the can for releasing the contents of the can. The apparatus comprises a frame having a saddle for positioning and holding the can, along with a mount for the linkage mechanism. The linkage mechanism controls the valve on the can and is retained pivotally by the frame. The mechanism comprises a plurality of pivotally connected links and terminates proximally with a rotatable wheel. In addition, the apparatus comprises means for securing an aerosol can to the frame with the valve on the can positioned for operation by the linkage mechanism, along with indexing means on the frame for connecting an extension pole having a lengthwise axis. The indexing means can lock the pole with the lengthwise axis at a predetermined angle relative to a long axis of the frame.

The frame may further comprise a handle. There may be a tether joined to the distal end of the linkage mechanism and passing through a portion of the frame, with the tether sufficiently long to allow operation of the valve when the can is elevated using an extension pole coupled to the indexing means. The apparatus may further comprise at least one spring for biasing the linkage mechanism in a position where the valve on the can is closed. The linkage mechanism may comprise a lever link having a distal end and a proximal end; a connecting link having a distal end hingedly attached to the proximal end of the lever link; and a contact link having a distal end hingedly attached to the connecting link, with the wheel positioned at the proximal end of the contact link. The means for securing may comprise a loop structure attached to the saddle, such as a hose clamp with a hand-adjustable screw. The indexing means may comprise an upper portion having a first lengthwise axis and joined to the frame and a lower portion distal from the frame having a first toothed bearing surface; and a lower portion having a second lengthwise axis and a second toothed bearing surface proximal to the frame and a distal portion adapted for joining an extension pole. The upper and lower portions are pivotally joined with a hinge through the first and second bearing surfaces such that the bearing surfaces mate with each other for locking the frame portions, with the first and second lengthwise axes positioned at a selected angle relative to each other. The lower portion of the indexing means may include an internally threaded hole for joining an extension pole.

DESCRIPTION OF THE DRAWINGS

These and other features, aspects, and advantages of the present invention will become better understood with reference to the following description, appended claims, and accompanying drawings, where:

DESCRIPTION OF THE PREFERRED EMBODIMENTS

Figure 1:
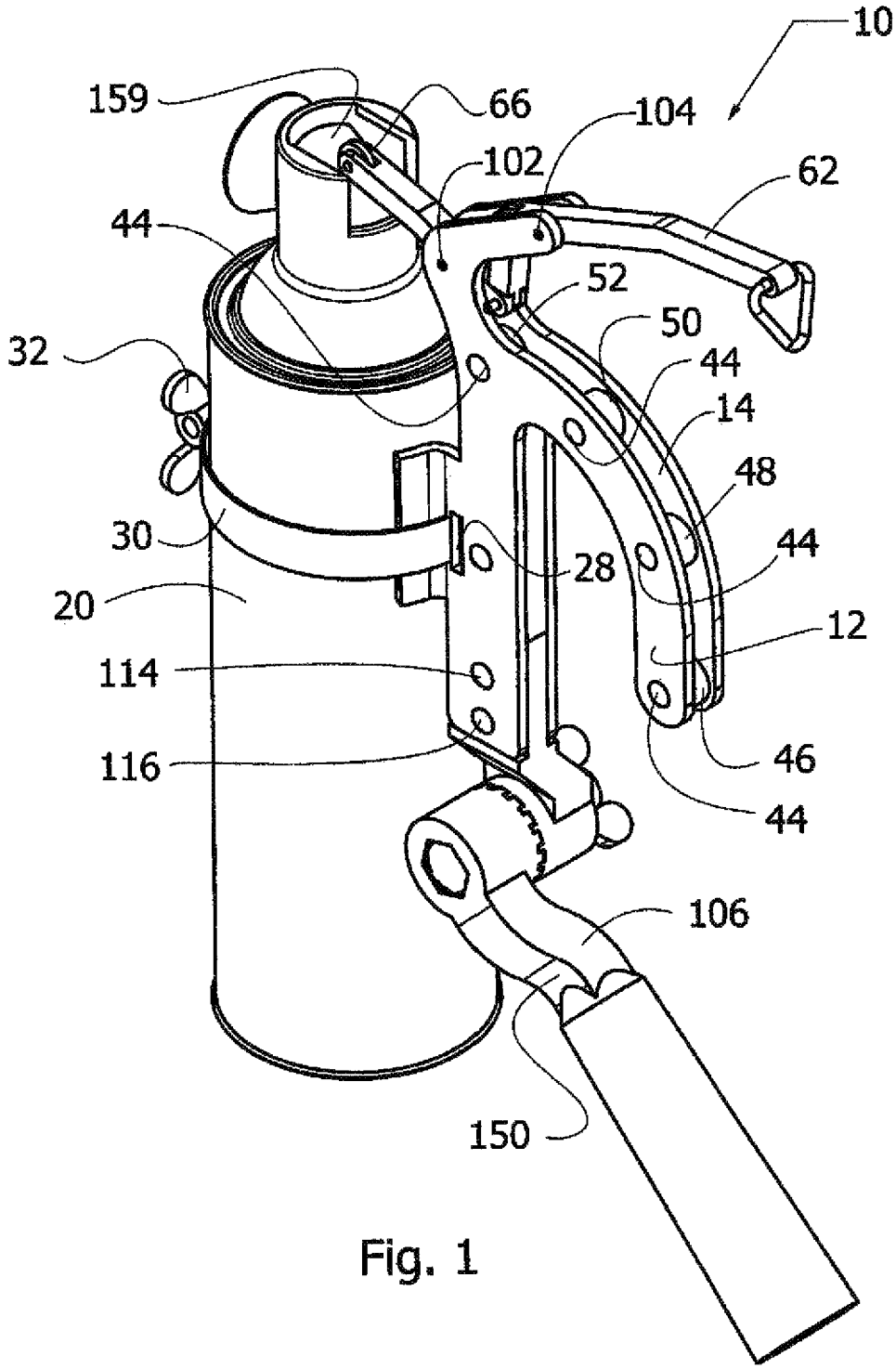
FIG. 1 is a top perspective view showing an assembly in accordance with the present invention, including an aerosol can clamped into place, a linkage assembly, and a swivel indexing extension pole adaptor.

In the following discussion, directional terms refer to the orientations of objects shown in the drawings. The term "proximal" refers to portions of objects closest to an aerosol can while the present invention is in use, and the term "distal" refers to portions of objects farthest from the can.

The present invention comprises an apparatus that includes a handle which allows an aerosol can to be used in hand held applications or in conjunction with an extension pole, such as a standard painter's extension pole. The present invention has two functions: it allows the aerosol can to be elevated and activated by means of pulling on a tether, or, in a hand held application, by pushing on a lever. It works with the modern safety style apertures which most new redesigned aerosol spray cans currently have. The apparatus includes a triggering linkage designed for use with all modern style safety push button aerosol spray cans, including cans which have angled buttons and cans with other, more standard, push buttons that require a straight downward vertical activating motion.

The present invention has several advantages in relation to prior art devices for operating aerosol cans. It is compact in size, does not need to be disassembled and reassembled for use, and does not require the use of any tools during normal operation. The user can mount a wide variety of aerosol spray cans into a saddle. The can is then secured into the assembly with a strap, such as a hose clamp, which draws the can tightly into place, eliminating the use of multiple adaptor rings. The user may operate the can and assembly in a hand held operation. A handle allows one to simply grasp the handle with one's hand then activate the can by using one's thumb or the palm of the other hand to push the lever link downward. It lessens the amount of effort required by the user to activate the can and gives the operator more control. The operator is able to release the contents of the can for longer periods of time. The lever link can also be pushed downward with the user's other hand.

Alternatively, the assembly may be attached to an extension pole, such as a standard painter's extension pole, to elevate an aerosol can to greater heights. When elevated, the user can pin point the spray direction of the can contents using an indexing swivel adaptor. The contents of the can may be dispersed by pulling on a tether attached to the lever link, thereby activating a series of links to depress the can's activating nozzle and release the contents stored within the can. Because the contents of the aerosol container are released in a direction facing away from the assembly, they are unlikely to damage the trigger assembly.

The point at which the contact link engages the nozzle of an aerosol can has a free-spinning wheel, enabling the device to be used with all new safety style buttons. These safety style buttons are angled and recessed, and they must be pushed in a downward angled motion. The wheel reduces any hang-ups on either the standard vertically pushed buttons or the safety style buttons. When the lever link is pulled or pushed down the wheel rolls downward onto the button. Once downward pressure is released from the linkage mechanism, the spring tension on the can button causes the wheel to return to its natural state, halting the contents from further being dispersed.

Figure 4:
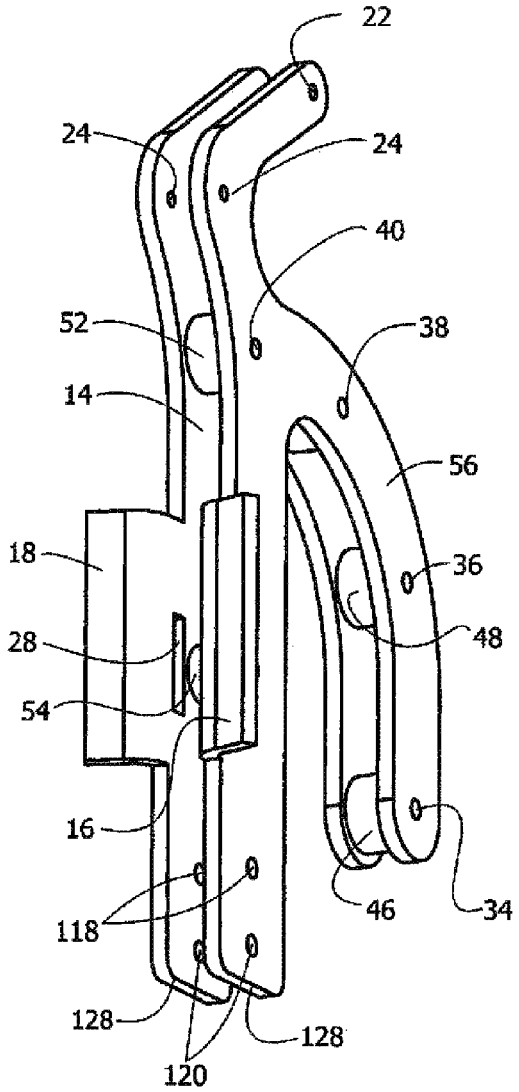
FIG. 4 is a side perspective view of the frame of the assembly of FIG. 1.
Figure 5:
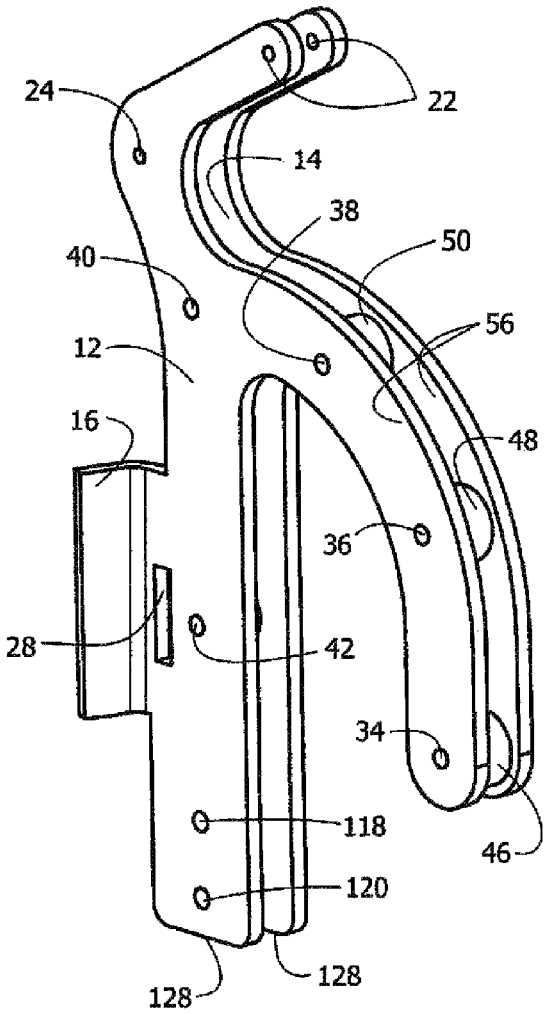
FIG. 5 is another side perspective view of the frame of the assembly of FIG. 1.

One embodiment of the present invention comprises an operating assembly 10 with paired mirror image frame plates, designated 12 and 14, respectively, in FIGS. 1-5. The frame plates 12 and 14, shown in FIGS. 4 and 5, include saddle extensions 16 and 18, respectively. Saddle extensions 16 and 18 form a left and right side of a saddle which accepts an aerosol can 20, shown in FIGS. 1, 2, and 3. The extensions 16 and 18 may be curved to form a partial cylinder as shown in FIGS. 4 and 5. The upper portion of each plate 12 and 14 includes a series of through holes 22 and 24. These holes are used as hinge points for the linkage mechanism 26 described later. Rectangular through holes 28, shown in FIGS. 4 and 5, accommodate a modern aftermarket hose clamp 30, shown in FIGS. 1, 2, 3 and 10, which passes through each frame plate and encompasses the outside cylindrical surface of the aerosol can 20. Hose clamp 30 draws the can 20 into the saddle formed by saddle extensions 16 and 18 and can be tightened to hold the can in place by means of tightening a thumb screw 32, shown in FIG. 2. Through holes 34, 36, 38, 40, and 42, shown respectively in FIGS. 4 and 5, are symmetrical in size and location, allowing a series of fastening devices 44, such as rivets, shown in FIGS. 1 and 6, to draw both plates tightly against a series of spacers 46, 48, 50, 52, and 54, shown in FIGS. 1, 3, 4, and 5, with even pressure. Spacer 54 may have a slightly smaller diameter than the other spacers to avoid interfering with the hose clamp 30 as it passes through rectangular holes 28. The spacers allow the operating linkage mechanism 26 to move freely when they are assembled and placed between the frame plates 12 and 14, with the frame plates cinched together and tightly aligned with each other.

Each frame plate 12 and 14 includes a handle section 56, respectively, shown in FIGS. 4 and 5. The handle formed by the combination of handle sections 56 allows the device to be used in hand-held applications The handle sections are located opposite the saddle, facing distally and downwardly.

The handles 56 may be curved with a radius forming an opening large enough to allow the operator enough space to grasp the handle. While gripping the handle, one may use the lever link to activate the aerosol spray from the can by using another portion of the operator's body, such as the thumb or a palm from the opposite hand.

Figure 6:
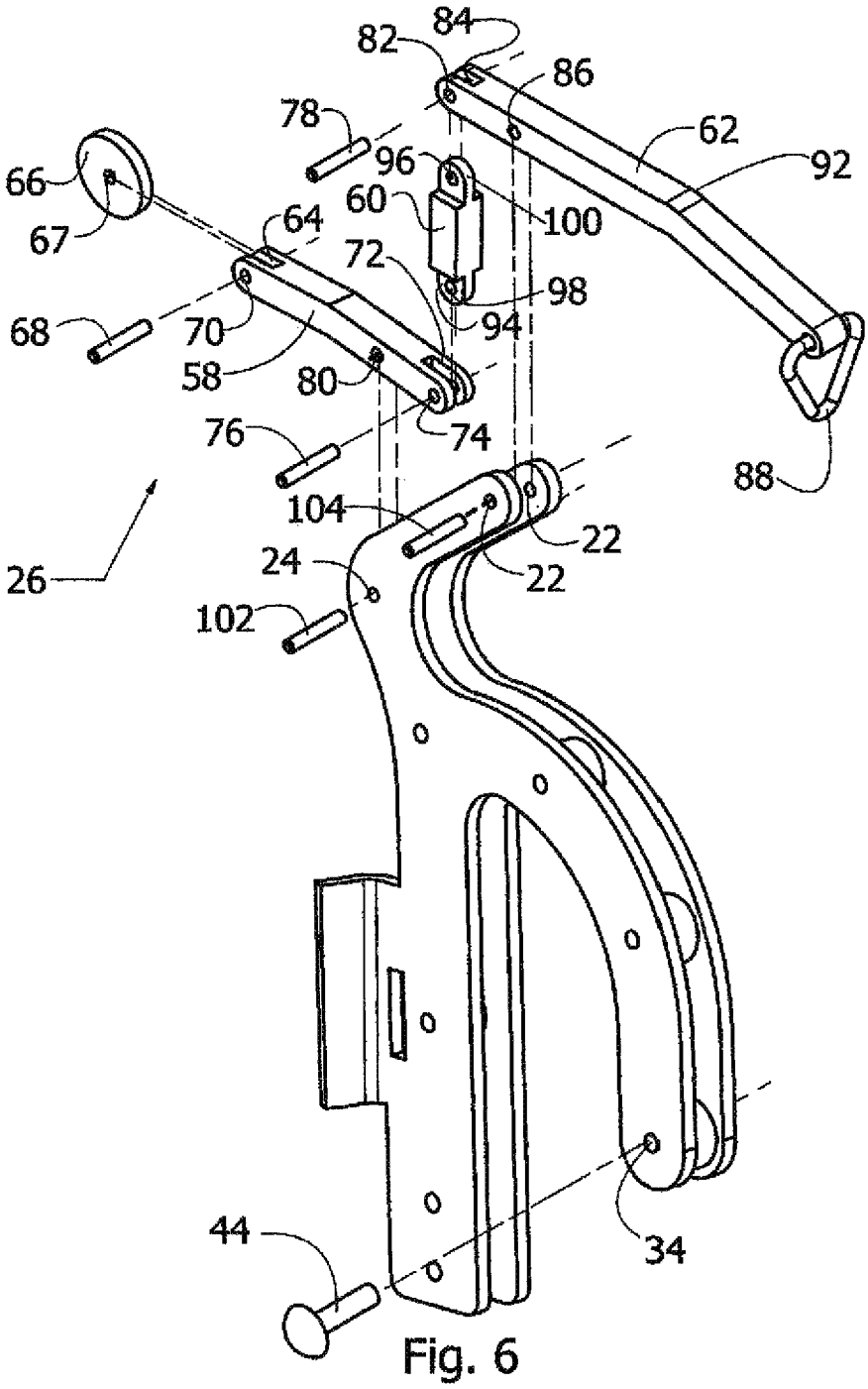
FIG. 6 is an exploded perspective view of the linkage mechanism of the assembly of FIG. 1.

The linkage mechanism 26, shown in detail in FIG. 6, comprises three links: a contact link 58, a first connecting link 60, and a lever link 62. Contact link 58 has a slot 64 centrally located at its proximal end to accept the roller wheel 66, shown in FIGS. 1 and 6. The wheel 66 is held in place with pin 68, which is press fitted into smaller-diameter hole 70 on contact link 58. Slot 72 is located at the distal end of connecting link 60, with through holes 74 sized to accommodate another hinge pin 76. Hole 80 passes through the central portion of contact link 58 and is used for mounting the contact link between frame plates 12 and 14.

Lever link 62 has a through hole 82 passing through the proximal end, which includes a slot 84. Through hole 86 accommodates a hinge pin 88 that also passes through holes 22 in frame plates 12 and 14. The distal end of lever link 62 may accommodate a split ring 88 or other means for fastening the end of tether 90 to the lever link. Lever link 62 may be formed with an angle 92 or curve to facilitate operation with either a user's body part or a tether.

Connecting link 60 has tangs 94 and 96 located at its proximal and distal ends, respectively. Tang 94 has a through hole 98 and is slightly narrower than the slot 72 on the contact link 58, allowing the tang 94 to be inserted into the slot 72 and then pinned in place using hinge pin 76. Similarly, tang 96 is slightly narrower than the slot 84 of the lever link and has a through hole 100, with hinge pin 78 holding tang 96 in slot 84 of the lever link 62. Hinge pins 76 and 78 are preferably slightly larger in diameter than holes 74 and 82, allowing a tight press fit of the pins into the holes 74 and 82 and a looser fit into holes 98 and 100, so that connecting link 60 can pivot freely relative to contact link 58 about the hinge pin 68 and relative to the lever link 62 about the hinge pin 76.

Hinge pins 102 and 104, shown in FIGS. 1, 2, 6 and 10, are smaller in diameter than holes 22 and 24 in frame plates 12 and 14, so that the hinge pins 102 and 104 fit tightly into holes 80 and 86 and fit loosely into holes 22 and 24. Through holes 22 are located at a greater height than through holes 24. The length of the connecting link 60 is substantially the same as the vertical distance between holes 22 and 24.

Figure 7:
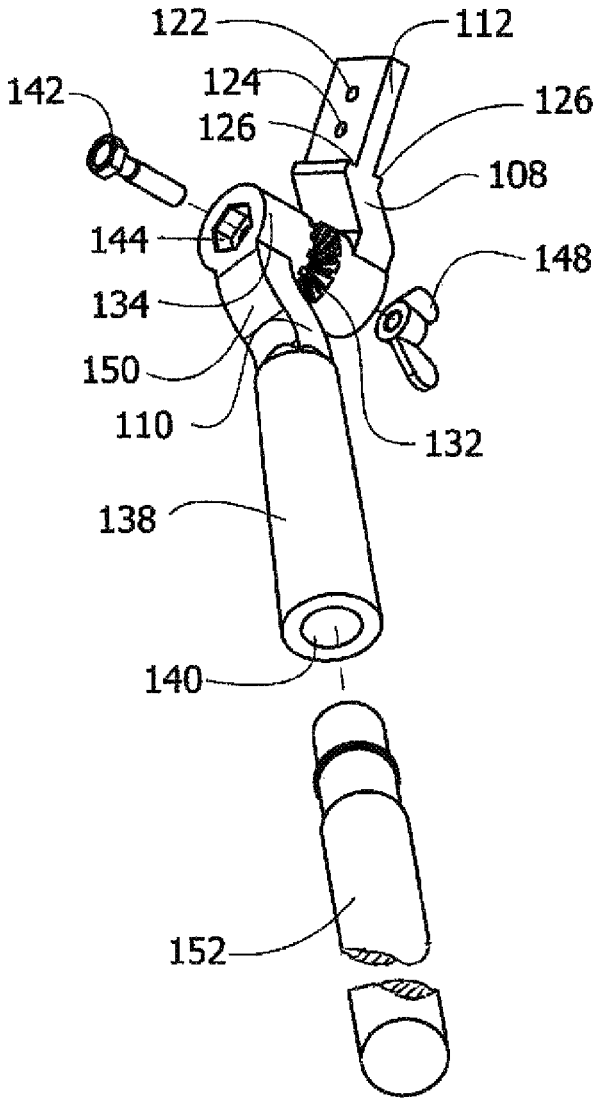
FIG. 7 is an exploded perspective view of the indexing means of the assembly of FIG. 1.
Figure 9:
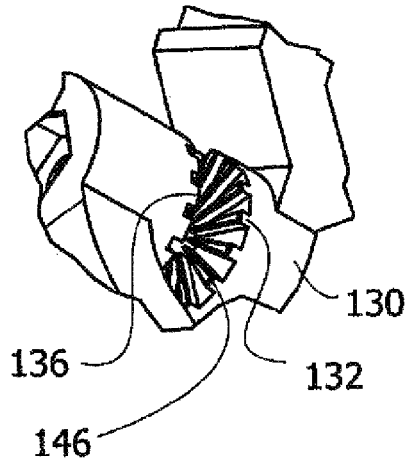
FIG. 9 is a perspective view of a portion of the indexing means of the assembly of FIG. 7.
Figure 8:
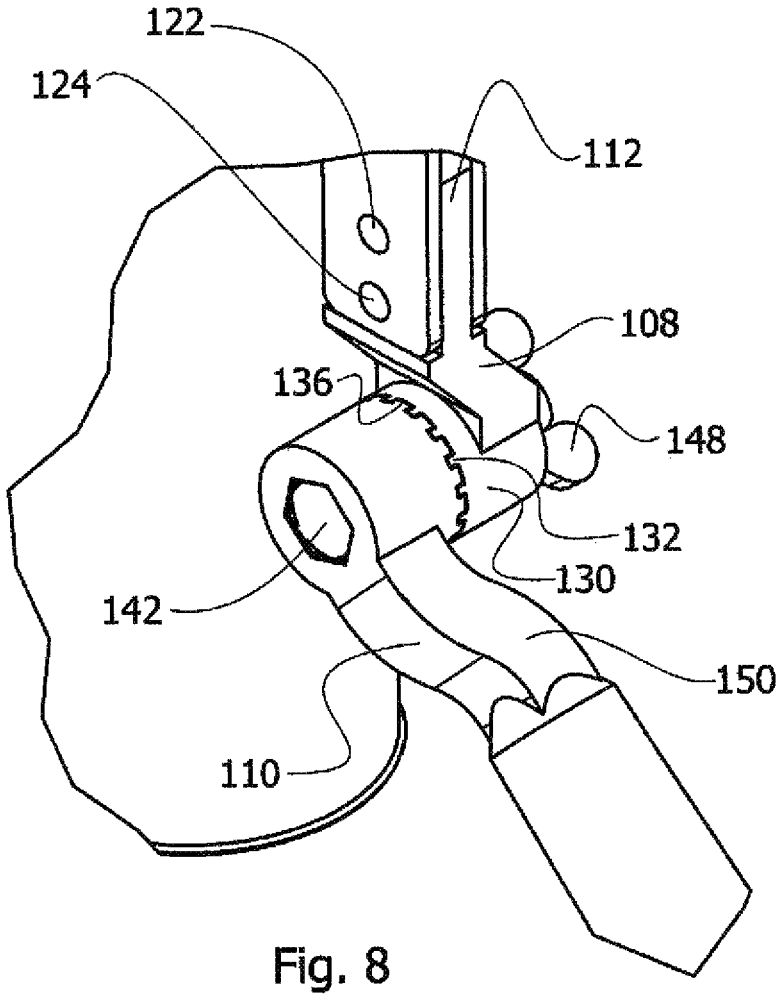
FIG. 8 is another exploded perspective view of a portion of the indexing means of FIG. 7.

An indexing pole adapter 106 has an upper portion 108 and a lower portion 110, shown in FIGS. 7-9. Upper portion 108 has a narrow rectangular shaped extension 112 that fits between the frame plates 12 and 14 and is secured in place by suitable fasteners 114 and 116, such as rivets, passing through holes 118 and 120 in plates 12 and 14 and through holes 122 and 124 in extension 112. Extension 112 has substantially the same thickness as the spacers 46, 48, 50, 52, and 54 used to maintain the correct separation for the triggering linkage. Shoulders 126, shown in FIG. 7, are pre-formed in the adaptor 108 and butt against the lower edges 128 of frame plates 12 and 14 to provide a more rigid joint between the adapter upper portion and the frame. Located at the lower end of the adaptor upper portion 110 is a cylindrical section 130 having a central axis oriented perpendicular to the extension 112 and a face 132 with series of tooth-like ridges at one end of the cylinder, shown in FIGS. 7 and 8.

Lower portion 110 of the indexing adapter 106 has a cylindrical section 134, also with a face 136 having tooth-like ridges at one end of the cylinder. The cylindrical section 134 is joined to an elongated section 138 having an internally threaded opening 140 that is mateable with the externally threaded end of an extension pole, such as a painter's extension pole.

The upper and lower portions 108 and 110 are joined together with the faces 132 and 136 held against each other, secured by a hex bolt 142 which passes completely through holes 144 and 146 in each cylindrical section and a wing nut 148, as shown in FIG. 8. The mated faces 132 and 136 provide an indexing joint with the respective ridges interlocked.

The adaptor 106 incorporates an offset 150, allowing the adapter 106 to be centrally located in relationship with the threaded opening 140 to maintain the center of gravity of the can 20 and linkage mechanism, formed by links 58, 60, and 62, in alignment with a coupled extension pole.

The assembly of the present invention can be manufactured with any plastic or metal parts that provide suitable durability and rigidity. The frame plates 12 and 14 and the links 58, 60, and 62 can be formed in any number of ways. For example, they may be made from a non-corrosive material, such as a sturdy light weight type aluminum, with a thickness sufficient to allow the plates to remain rigid and withstand pressures exerted during operating of the triggering mechanism. The indexing pole adapter sections 108 and 110 may be formed from plastic or fiberglass, and they may each be molded as a single piece. The frame, adaptor, and links may be forged, cast, molded, and/or bent from a variety of materials. Aluminum is one such material suitable for the frame and links. The hinge pins may be formed from stainless steel.

Once the connecting link 60 is pinned into both contact link 58 and the lever link 62, and the wheel 66 is pinned into the proximal end of the contact link, the linkage assembly may then be placed in position between both frame plates, aligning holes 110 on the contact link with holes 22 and 24 in the frame plate and hole 86 on the lever link with holes 22 and 26, at which point another hinge pin is pressed into each hole. Ring 88 may be inserted into a hole near the end of the lever link 62 (FIGS. 2 and 6) and then crimped closed. The upper portion 108 of the indexing pole adapter is secured between the frame plates 12 and 14 with fasteners 114 and 116. The upper and lower portions 130 and 110 of the indexing pole adapter 106 are mated with the ridged surfaces interlocking as shown in FIGS. 8 and 9, secured with hex bolt 142 on one side of the frame assembly and wing nut 148 on the other side.

Figure 2:
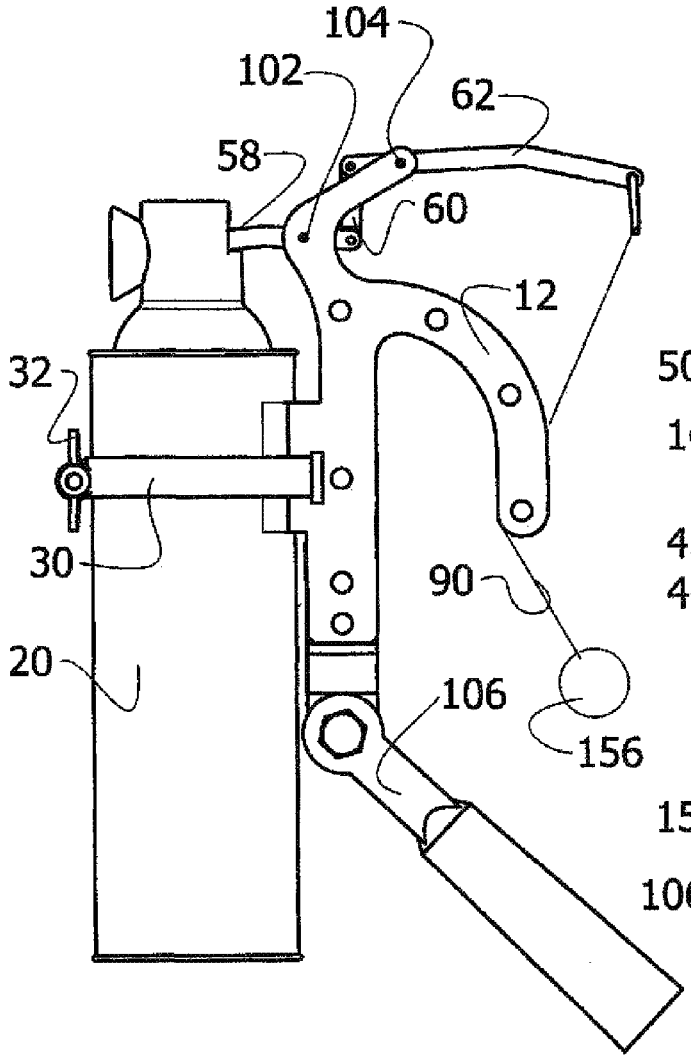
FIG. 2 is side view of the assembly of FIG. 1 including a tether.
Figure 3:
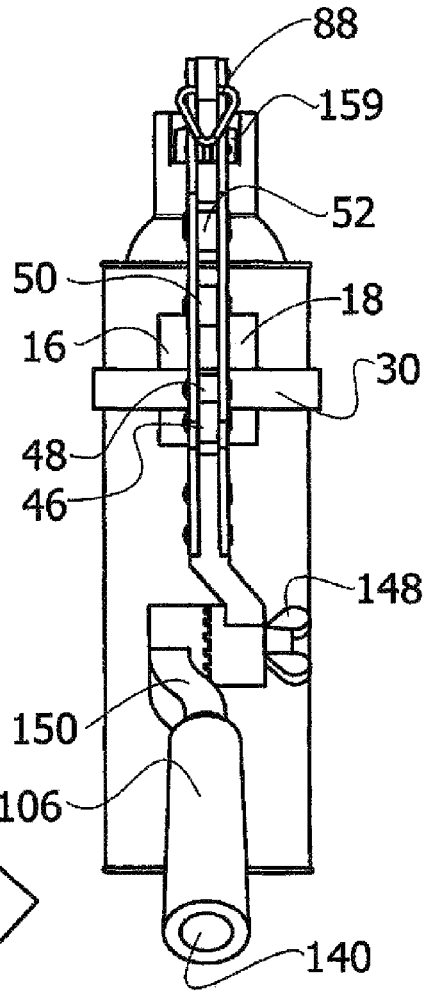
FIG. 3 is a rear view of the assembly of FIG. 1.

Operation and use of the assembly is simple and straightforward. The invention can either be used either in a hand held operation or with the tether and with threaded indexing adaptor screwed onto an extension pole, such as a standard common painter's extension pole, to provide the ability to raise the can and assembly or extend them laterally beyond one's reach. The assembly may be threaded onto the pole by using the female threads molded into the opening 140 in lower portion of the adaptor 108, shown in FIG. 7. If the assembly is to be used with a pole, a tether 90, shown in FIGS. 2 and 10, can be tied onto the snap ring 88 located at the distal end of the lever link 62. The tether 90 may be routed between the frame plates 12 and 14 and between spacers 50 and 52, as shown in FIG. 2. The tether 90 should be long enough to enable an operator to pull on the tether when the device is joined to a standard painter's extension pole. The tether 90 may be terminated at its free end with a hand grip 156, shown in FIGS. 2 and 10.

Figure 10:
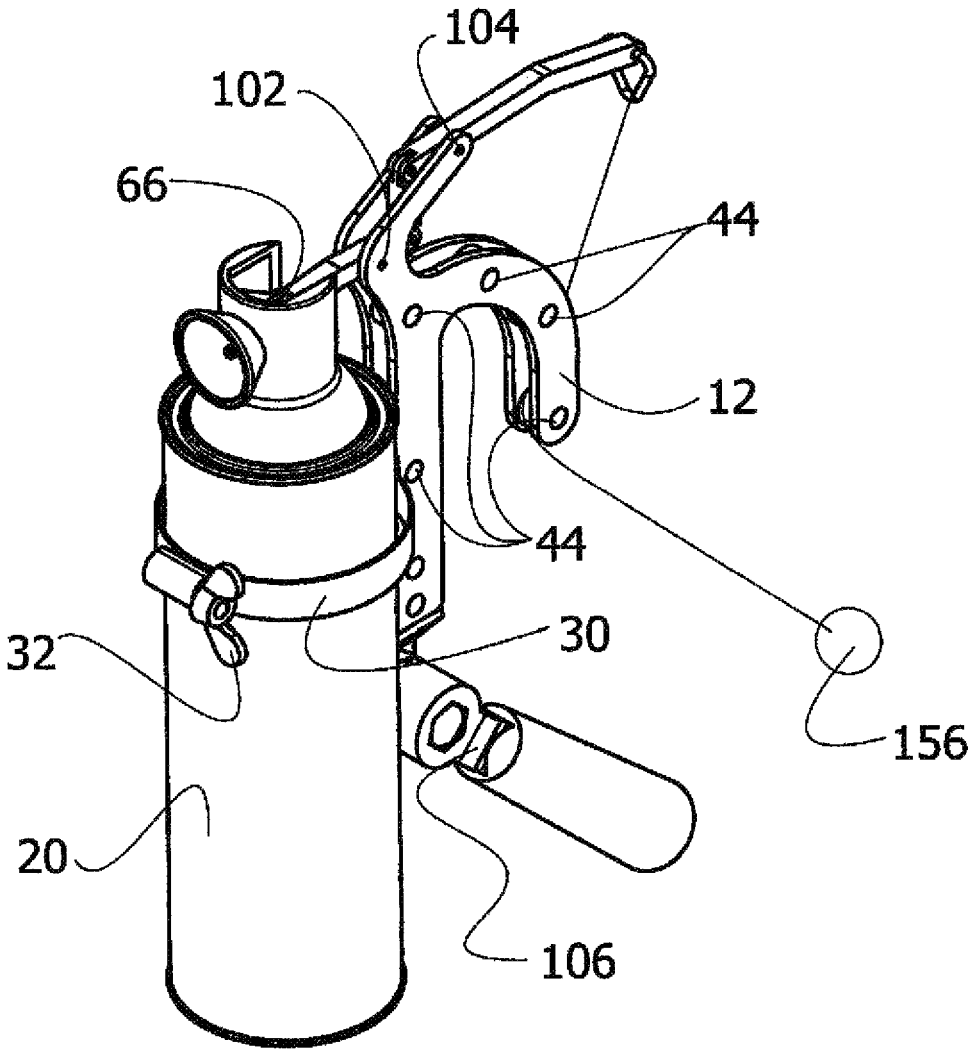
FIG. 10 is a perspective view of the assembly of FIG. 1 with an aerosol can positioned but not secured in place.
Figure 11:
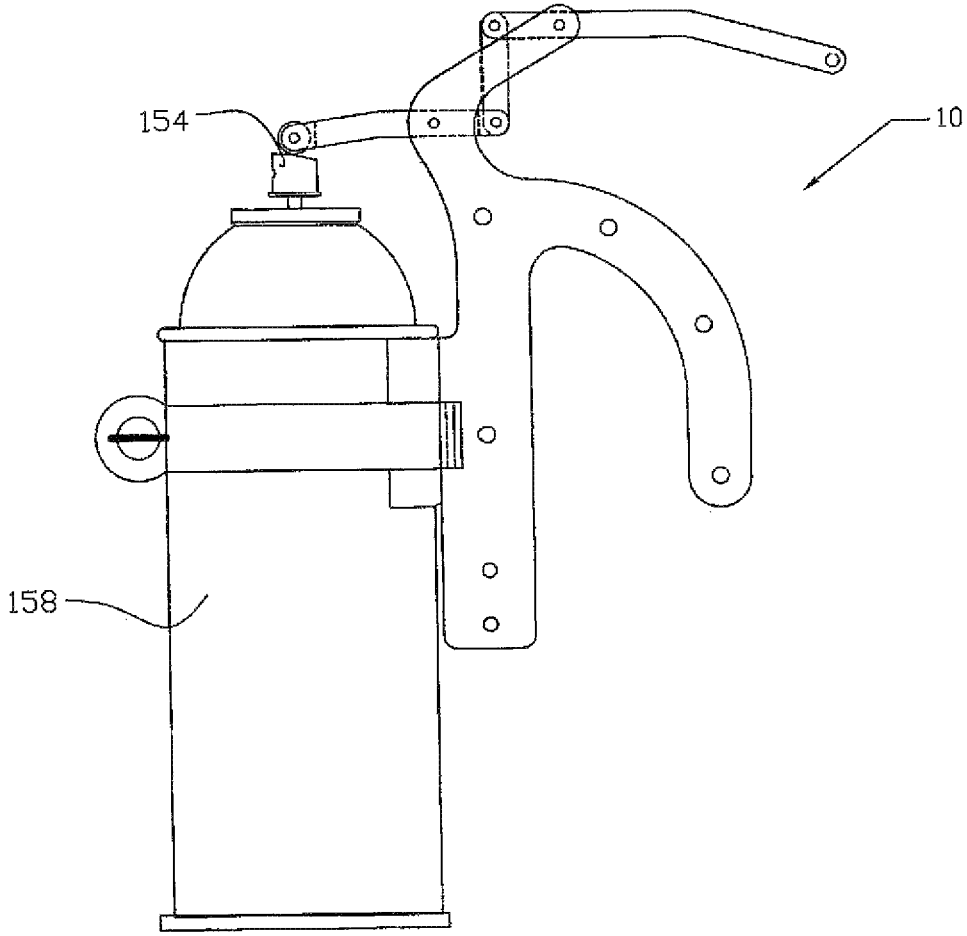
FIG. 11 is a side view of the assembly of FIG. 1 with an aerosol can having a conventional button valve.

An aerosol can 20 or 158 (FIG. 11) is positioned in the saddle formed by saddle extensions 16 and 18, as shown in FIG. 10. It is then secured in place using hose clamp 30. Depending on the diameter of the can, the vertical position of the may be moved up or down relative to the frame plates to position the valve button 154 such that the wheel 66 at the end of the contact link 58 will make contact with the proper part of the button to open the valve. To operate the assembly, the distal end of lever link 62 is either pulled down by the tether 90 using the tether hand grip 156 or is pushed down using the hand or another body part. The downward motion of the lever link 62 causes the link to pivot about the hinge pin passing through frame holes 22 and 26, pulling the connecting link 60 and the distal end of the contact link 58 upward. The contact link 58 pivots about the hinge pin passing through hole 110 and frame holes 24, moving the proximal end of the contact link downward and allowing roller wheel 66 to make contact with the aerosol can's button 154. Button 154 is forced downward, opening the can aperture to release the contents of the can 20. The linkage mechanism 26, in conjunction with the roller wheel 66, allows the present invention to be used with any aerosol can having a button located on the top of the can. FIG. 11 shows the invention with a can having one of the older type buttons for operating the valve.

Accordingly, the tether can connect to a variety of different triggering mechanisms which will depress the can's nozzle. Alternative trigger configurations are possible that provide the same results, and the linkage mechanism may be hinged at different locations. Also, the handle feature may have other configurations. One or more springs may be incorporated to assist in returning the contact wheel to its natural neutral state.

While the above description contains much specificity, these should not be construed as limitations of the scope of the invention, but as exemplifications of the presently preferred embodiments thereof. Many other ramifications and variations are possible within the teachings of the invention. Thus the scope of the invention should be determined by the appended claims and their legal equivalents, and not by the examples given.

LIST OF CALLOUT NUMBERS operating assembly 10
frame plates 12 and 14
saddle extensions 16 and 18
aerosol can 20
holes 22 and 24 holes in plates 12 and 14
linkage mechanism 26
rectangular through holes 28 for hose clamp 30
hose clamp 30
thumb screw 32
holes 34, 36, 38, 40, and 42, (for spacers, alternating from 1 plate to the other)
rivets 44
spacers 46, 48, 50, 52, and 54 (numbered so 54 is the one next to the hose clamp)
handle sections 56 on frame plates
contact link 58
connecting link 60
lever link 62
slot 64 in contact link 58
roller wheel 66
hold 67 in roller wheel
with pin 68 for roller wheel
hole 70 on contact link 58 for pin/roller wheel
slot 72 at the distal end of connecting link 60,
holes 74 for hinge pin 76
hinge pins 76 and 78
hole 80 through the central portion of contact link 58
hole 82 at proximal end of lever link 62
slot 84 in lever link
hole 86 for mounting in frame
split ring 88
tether 90
angle 92
tangs 94 and 96 on connecting link 60
hole 98 in tang 94
hole 100 in tang 96
hinge pins 102 and 104 hold linkage mechanism in frame holes 22 and 24
indexing pole adapter 106
upper portion 108 of pole adapter
lower portion 110 of pole adapter
narrow rectangular shaped extension 112 that fits between the frame plates 12 and 14
fasteners 114 and 116
holes 118 and 120 in plates 12 and 14
holes 122 and 124 in extension 112.
Shoulders 126
lower edges 128 of frame plates
cylindrical section 130
face 132 with series of tooth-like ridges
cylindrical section 134 of lower portion
face 136 having tooth-like ridges
elongated section 138
internally threaded opening 140
hex bolt 142
holes 144 and 146 in each cylindrical section
wing nut 148
offset 150
extension pole 152
valve button 154
tether hand grip 156
aerosol can 156 with button top in FIG. 11

I claim:

1. An apparatus for operating an aerosol can, the can having a button-operated valve on top of the can for releasing the contents of the can, said apparatus comprising:

a frame comprising a saddle for positioning and holding the can, a handle, and a linkage mechanism mount;

a linkage mechanism for controlling the valve on the can, said mechanism retained pivotally by said frame, said mechanism comprising a plurality of pivotally connected links and terminating proximally with a rotatable wheel; and means for securing an aerosol can to said frame with the valve on the can positioned for operation by said linkage mechanism.

2. The apparatus of claim 1, further comprising indexing means on said frame for connecting an extension pole, the pole having a lengthwise axis, said indexing means locking the pole with the lengthwise axis at a selected angle relative to a long axis of said frame.

3. The apparatus of claim 2, further comprising a tether joined to the distal end of said linkage mechanism and passing through a portion of said frame, wherein said tether is sufficiently long to allow operation of the valve when the can is elevated using an extension pole coupled to said indexing means.

4. The apparatus of claim 2, wherein said indexing means comprises:

an upper portion having a first lengthwise axis and joined to said frame and a lower portion distal from said frame having a first toothed bearing surface; and a lower portion having a second lengthwise axis and a second toothed bearing surface proximal to said frame and a distal portion adapted for joining an extension pole;

wherein said upper and lower portions are pivotally joined with a hinge through said first and second bearing surfaces, such that said bearing surfaces mate with each other for locking the frame portions with the first and second lengthwise axes positioned at a selected angle relative to each other.

5. The apparatus of claim 4, wherein said lower portion of said indexing means includes an internally threaded hole for joining an extension pole.

6. The apparatus of claim 1, further comprising at least one spring for biasing said linkage mechanism in a position where the valve on the can is closed.

7. The apparatus of claim 1, wherein said linkage mechanism comprises:

a lever link having a distal end and a proximal end;

a connecting link having a distal end hingedly attached to said proximal end of said lever link; and a contact link having a distal end hingedly attached to said connecting link, wherein said wheel is positioned at the proximal end of said contact link.

8. The apparatus of claim 1, wherein said means for securing comprises a loop structure attached to said saddle.

9. The apparatus of claim 8, wherein said loop structure comprises a hose clamp with a hand-adjustable screw.

10. An apparatus for operating an aerosol can, the can having a button-operated valve on top of the can for releasing contents of the can, said apparatus comprising:

a frame comprising a saddle for positioning and holding the can, and a mount for said linkage mechanism;

a linkage mechanism for controlling the valve on the can, said mechanism retained pivotally by said frame, said mechanism comprising a plurality of pivotally connected links and terminating proximally with a rotatable wheel;

means for securing an aerosol can to said frame with the valve on the can positioned for operation by said linkage mechanism; and indexing means on said frame for connecting an extension pole, the pole having a lengthwise axis, and locking said pole with the lengthwise axis at a selected angle relative to a long axis of said frame.

11. The apparatus of claim 10, wherein said frame further comprises a handle.

12. The apparatus of claim 10, further comprising a tether joined to the distal end of said linkage mechanism and passing through a portion of said frame, wherein said tether is sufficiently long to allow operation of the valve when the can is elevated using an extension pole coupled to said indexing means.

13. The apparatus of claim 10, further comprising at least one spring for biasing said linkage mechanism in a position where the valve on the can is closed.

14. The apparatus of claim 10, wherein said linkage mechanism comprises;

a lever link having a distal end and a proximal end;

a connecting link having a distal end hingedly attached to said proximal end of said lever link; and a contact link having a distal end hingedly attached to said connecting link;

wherein said wheel is positioned at the proximal end of said contact link.

15. The apparatus of claim 10, wherein said means for securing comprises a loop structure attached to said saddle.

16. The apparatus of claim 15, wherein said loop structure comprises a hose clamp with a hand-adjustable screw.

17. The apparatus of claim 10, wherein said indexing means comprises;

an upper portion having a first lengthwise axis and joined to said frame and a lower portion distal from said frame having a first toothed bearing surface; and a lower portion having a second lengthwise axis and a second toothed bearing surface proximal to said frame and a distal portion adapted for joining an extension pole;

wherein said upper and lower portions are pivotally joined with a hinge through said first and second bearing surfaces, such that said bearing surfaces mate with each other for locking the frame portions with the first and second lengthwise axes positioned at a selected angle relative to each other.

18. The apparatus of claim 17, wherein said lower portion of said indexing means includes an internally threaded hole for joining an extension pole.

* * * * *